US006411043B1

(12) United States Patent
Jeong et al.

(10) Patent No.: US 6,411,043 B1
(45) Date of Patent: Jun. 25, 2002

(54) AC TYPE PLASMA DISPLAY PANEL HAVING IMPROVED PARTITIONS

(75) Inventors: Jae-seok Jeong, Asan; Tae-kyoung Kang; Young-hwa Song, both of Cheonan, all of (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 09/841,175

(22) Filed: Apr. 25, 2001

(30) Foreign Application Priority Data

Apr. 28, 2000 (KR) ..... 00-22800

(51) Int. Cl.[7] ..... H05B 41/00

(52) U.S. Cl. ..... 315/169.3; 315/169.4; 313/485; 313/495

(58) Field of Search ..... 445/24; 315/169.3, 315/169.4; 313/485, 495

(56) References Cited

U.S. PATENT DOCUMENTS 3,885,195 A * 5/1975 Amano ..... 315/169 TV 5,967,872 A 10/1999 Betsui et al. ..... 445/24

FOREIGN PATENT DOCUMENTS

KR 97-71937 11/1997

* cited by examiner

*Primary Examiner*—David Vu
(74) *Attorney, Agent, or Firm*—Staas & Halsey LLP

(57) ABSTRACT

An AC type plasma display panel including a front substrate, strip-shaped common and scan electrodes on a bottom surface of the front substrate, bus electrodes along one edge of a side of respective the common and scan electrodes, a first dielectric layer on the bottom surface of the front substrate to cover the electrodes, a protective layer on a bottom surface of the first dielectric layer, a rear substrate opposite to and facing the front substrate, address electrodes on a top surface of the rear substrate to be perpendicular with the common and scan electrodes, a second dielectric layer on the rear substrate to cover the address electrodes, partitions comprising strip-shaped main partitions formed on the second dielectric layer, and auxiliary partitions connected to the main partitions to partition a discharge space, and R, G and B phosphor layers formed on the inner walls of the partitions.

24 Claims, 6 Drawing Sheets

AC TYPE PLASMA DISPLAY PANEL HAVING IMPROVED PARTITIONS

CROSS-REFERENCE TO RELATED APPLICATIONS

This application claims the benefit of Korean Application No. 2000-22800, filed Apr. 28, 2000, in the Korean Industrial Property Office, the disclosure of which is incorporated herein by reference.

BACKGROUND OF THE INVENTION

1. Field of the Invention

The present invention relates to a plasma display panel, and more particularly, to an alternating-current (AC) type plasma display panel having improved partitions formed on a rear substrate of the panel.

2. Description of the Related Art

In general, a plasma display panel is a picture display device that provides desired figures, characters or graphics by injecting gases between two substrates having electrodes thereon, and exciting phosphors using ultraviolet (UV) rays generated by the discharged gases.

A plasma display panel is classified into a direct-current (DC) type and an alternating-current (AC) type according to the type of driving voltages applied to discharge cells (i.e., a discharge type) and is also classified into an opposite discharge type and a surface discharge type according to the arrangement type of electrodes.

A DC type plasma display panel is constructed such that all electrodes are exposed to a discharge space such that a migration of charges directly occurs between the corresponding electrodes. On the other hand, an AC type plasma display panel is constructed such that at least one electrode is covered by a dielectric layer, and there is no direct migration of charges between the corresponding electrodes. Instead, ions and electrons produced by the discharge adhere to the surface of the dielectric layer to form wall charges. In addition, sustained discharges (i.e., sustaining discharges) are allowed by a sustaining voltage.

In an opposite discharge plasma display panel, an address electrode and a scan electrode are opposed to each other at each unit pixel, and an addressing discharge and a sustaining discharge occur between the two electrodes. On the other hand, in a surface discharge plasma display panel, an address electrode, and common and scan electrodes, which correspond with the address electrode, are provided for each unit pixel to cause the addressing discharge and the sustaining discharge.

FIG. 1 illustrates a first conventional AC type plasma display panel 10. The plasma display panel 10 has a front substrate 11 and a rear substrate 12 opposed to and facing each other. Strip-shaped common electrodes 13 and strip-shaped scan electrodes 14 are alternately formed on a bottom surface of the front substrate 11. A bus electrode 15, which reduces the line resistance, is formed on a bottom surface of each of the common and scan electrodes 13 and 14. A first dielectric layer 16 is formed on a bottom surface of the front substrate 11 to cover the common electrodes 13, the scan electrodes 14, and the bus electrodes 15. A protective layer 17, such as a magnesium oxide (MgO), is formed on a bottom surface of the first dielectric layer 16.

Strip-shaped address electrodes 18 are formed on a top surface of the rear substrate 12 to be perpendicular with the common and scan electrodes 13 and 14. The address electrodes 18 are covered by a second dielectric layer 19.

Strip-shaped partitions 100 are formed on the second dielectric layer 19 parallel with the address electrodes 18. Red (R), green (G) and blue (B) phosphor layers 110 are formed on the inner walls of the partitions 100.

In the conventional plasma display panel 10 having the aforementioned configuration, if a voltage is applied between the scan electrode 14 and the address electrode 18, a preliminary discharge occurs to fill wall charges therebetween. In such a state, if a voltage is applied to the common electrode 13 and the scan electrode 14, a glow discharge occurs to produce plasma, and (UV) rays generated by the plasma excite the phosphor layers 110, thereby implementing a picture image.

The partitions 100 may be formed on the rear substrate 12 by a screen printing method, a sandblast method, or a dry film method. However, since the partitions 100 have the phosphor layers 110 of different colors formed on the inner walls and bottoms thereof, the amount of phosphors coated per unit area is small.

To overcome the problem caused by the small amount of phosphors, alternative partitions have been proposed. FIG. 2 is a partially exploded diagram of a rear substrate 22 of a second conventional plasma display panel, and only the characteristic parts will be described herein.

Referring to FIG. 2, a plurality of address electrodes 28 are formed on the rear substrate 22. The address electrodes 22 are covered by a dielectric layer (not shown). A matrix-type partition 200 is formed on the dielectric layer. The partition 200 includes first partitions 201 formed parallel to the address electrodes 28, and second partitions 202 formed to be perpendicular with the address electrodes 28. Accordingly, the space for partitioning discharge cells is defined by the first and second partitions 201 and 202. R, G and B phosphor layers (not shown) are formed on the inner walls of the first and second partitions 201 and 202.

The partition 200 has an increased phosphor layer coating area compared to the partition 100 shown in FIG. 1, which advantageously improves the luminance. However, in performing a vacuum exhausting step for removing impurities containing residual moisture being inside the panel, it is very difficult to attain exhaustion due to a closed structure of the partition 200. Thus, the exhausting step is prolonged.

FIG. 3 is a partially exploded diagram of a rear substrate 32 of a plasma display panel, and only the characteristic parts will be described herein, like in FIG. 2. As shown, a plurality of address electrodes 38 are formed on the rear substrate 32. The address electrodes 38 may be covered by a dielectric layer (not shown). A plurality of meandering partitions 300 are formed on the dielectric layer to be parallel with the address electrodes 38. Since the area where phosphor layers (not shown) are coated is increased in the partitions 300, the luminance is somewhat improved during radiation of the light. However, since the partitions 300 are not of a strip shape, it is quite difficult to fabricate these partitions 300.

Also, since the spaces defining the R, G and B discharge cells are not positioned along a line, it is quite difficult to drive the plasma display panel using the partitions 300. Further, due to the meandering partitions 300, it is difficult to form a black matrix, which is formed in the boundary of adjacent discharge cells for the purpose of enhancing color purity on the front substrate, at a desired position.

SUMMARY OF THE INVENTION

Accordingly, it is an object of the present invention to provide an AC type plasma display panel which can improve the luminance of phosphors while maintaining color purity by improving the structure of partitions formed on a rear substrate of the panel to increase the area where phosphor layers are coated.

It is another object of the present invention to provide an AC type plasma display panel which can facilitate exhaustion and driving by improving the structure of partitions comprising strip-shaped main partitions and auxiliary partitions.

Additional objects and advantages of the invention will be set forth in part in the description which follows and, in part, will be obvious from the description, or may be learned by practice of the invention.

Accordingly, to achieve these and other objects, there is provided an AC type plasma display panel including a front substrate, a plurality of strip-shaped common and scan electrodes formed on a bottom surface of the front substrate, bus electrodes formed along one side of respective edges of the common and scan electrodes, a first dielectric layer formed on the bottom surface of the front substrate to cover the common and scan electrodes, a protective layer formed on the bottom surface of the first dielectric layer, a rear substrate opposite to and facing the front substrate, a plurality of address electrodes formed on a top surface of the rear substrate to be perpendicular with the common and scan electrodes, a second dielectric layer formed on the rear substrate to cover the address electrodes, partitions, including main partitions formed on the second dielectric layer in a strip-shape and a auxiliary partitions connected to the main partitions, to partition a discharge space, and R, G and B phosphor layers formed on inner walls of the partitions.

According to an aspect of the present invention, the main partitions are formed at an angle to the address electrodes.

According to another aspect of the present invention, the auxiliary partitions may include first auxiliary partitions extending from one side wall of each of the main partitions lengthwise, and a plurality of second auxiliary partitions extending from the other side wall of the main partition lengthwise, the first and second auxiliary partitions being substantially perpendicular with the main partitions.

According to yet another aspect of the present invention, the first and second auxiliary partitions alternate with each other such that the first auxiliary partitions extend from one side wall of the main partition, and the second auxiliary partitions extend from the opposing side wall of the next main partition.

According to a further aspect of the present invention, the main partitions are formed parallel with the address electrodes.

According to a still further aspect of the present invention, the plurality of auxiliary partitions are formed extending from one side wall of each of the main partitions lengthwise, and are formed substantially perpendicular with the main partitions.

According to an additional aspect of the present invention the auxiliary partitions may be formed extending from one side wall of each of the main partitions and are oriented in a same direction.

According to another aspect of the present invention, the auxiliary partitions include a plurality of first auxiliary partitions extending from one side wall of each of the main partitions lengthwise, and second auxiliary partitions extending from an other side wall of the main partition lengthwise.

According to another aspect of the present invention, auxiliary partitions are formed on the main partitions lengthwise only at the regions where the B phosphor layers are formed.

According to another aspect of the present invention, phosphor layers are further formed extending from outer side walls of the auxiliary partitions.

According to another aspect of the present invention, the auxiliary partitions may be integrally formed on the side walls of the main partitions and have a length to provide a space between facing side walls of two neighboring main partitions.

BRIEF DESCRIPTION OF THE DRAWINGS

The above object and advantages of the present invention will become more apparent by describing in detail a preferred embodiment thereof with reference to the attached drawings in which.

DETAILED DESCRIPTION

Figure 1:
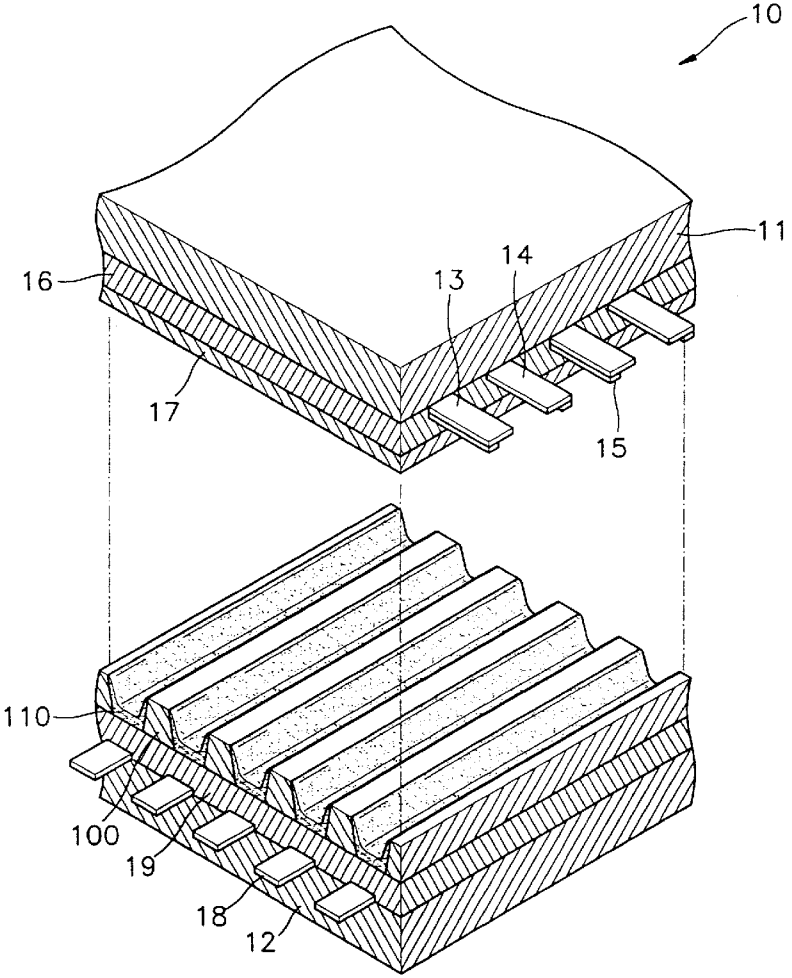
FIG. 1 (PRIOR ART)
FIG. 1 is a partially exploded perspective view illustrating a first conventional plasma display panel.
Figure 2:
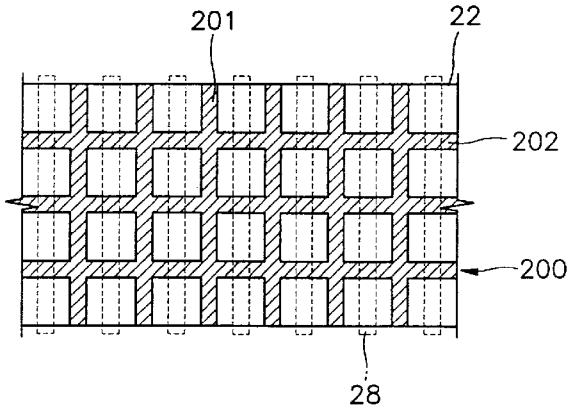
FIG. 2 (PRIOR ART)
FIG. 2 is a partially exploded plan view schematically illustrating a rear substrate of a second conventional plasma display panel.
Figure 3:
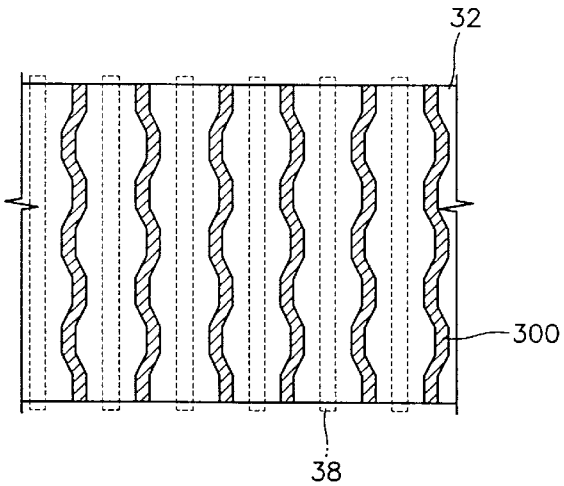
FIG. 3 (PRIOR ART)
FIG. 3 is a partially exploded plan view schematically illustrating a rear substrate of a third conventional plasma display panel.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 4:
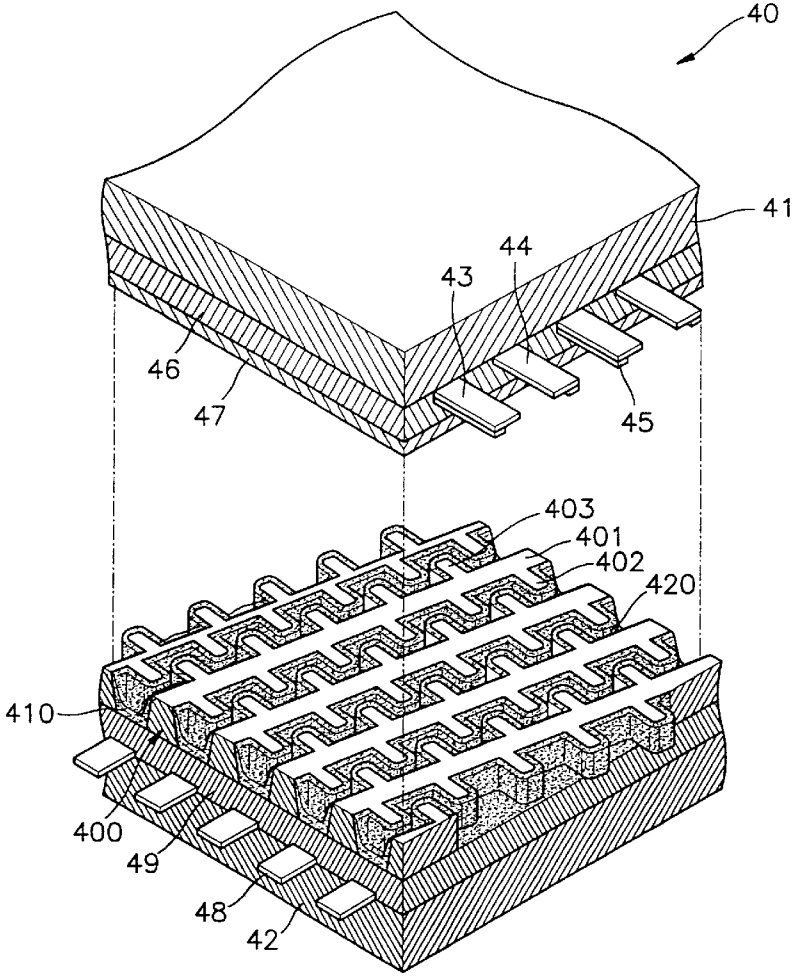
FIG. 4 is a partially exploded perspective view schematically illustrating a plasma display panel according to an embodiment of the present invention.

FIG. 4 illustrates a AC plasma display panel 40 according to an embodiment of the present invention. The plasma display panel 40 has a front substrate 41 and a rear substrate 42. Strip-shaped common electrodes 43 and strip-shaped scan electrodes 44 are alternately formed on a bottom surface of the front substrate 41. A bus electrode 45, which reduces line resistance, is formed on a bottom surface of each of the common and scan electrodes 43 and 44. A first dielectric layer 46 is formed on the bottom surface of the front substrate 41 to cover the common electrodes 43, the scan electrodes 44, and the bus electrodes 45. A protective layer 47, such as a magnesium oxide (MgO), is formed on a bottom surface of the first dielectric layer 46.

Strip-shaped address electrodes 48 are formed on a top surface of the rear substrate 42 to be perpendicular with the common and scan electrodes 43 and 44. The address electrodes 48 are covered by a second dielectric layer 49. However, it is understood that the second dielectric layer 49 is not required in all circumstances.

Partitions 400 are spaced a predetermined distance apart from each other to partition a discharge space and prevent cross-talk between address electrodes 48, are formed on the second dielectric layer 49. Each partition 400 includes a main partition 401 formed at a predetermined angle to the address electrodes 48, and auxiliary partitions 402 formed to be perpendicular with the main partition 401.

Specifically, the main partitions 401 are formed in a strip-shape on the second dielectric layer 49 at a predetermined angle to the address electrodes 48. The auxiliary partitions 402 (hereinafter to be referred to as "first auxiliary partitions") are formed at one side of each of the main partitions 401 to be substantially perpendicular with the main partition 401. The first auxiliary partitions 402 are integrally formed with the main partition 401. The first auxiliary partitions 402 protrude so as to be spaced a predetermined distance apart from each other lengthwise with respect to the main partition 401, thereby defining the discharge cells.

Also, second auxiliary partitions 403 are formed on the side opposite the side on which the first auxiliary partitions 402 are formed. Like the first auxiliary partitions 402, the second auxiliary partitions 403 are integrally formed with each of the main partitions 401, and protrude lengthwise with respect to the main partition 401. The first and second auxiliary partitions 402 and 403 preferably have the same length. Accordingly, in two neighboring main partitions, the first auxiliary partitions 402 protrude from one side wall of the main partition 401 and second auxiliary partitions 403 protrude from the opposing side wall of the next main partition 401, to then be alternately formed. The first and second auxiliary partitions 402 and 403 extend from the main partitions 401 and are preferably formed to have sufficient lengths to allow for a predetermined space 420 between the two neighboring main partitions 401. This space 420 forms a zig-zag pattern creating an exhaustion passage to facilitate exhaustion through the space 420.

R, G and B phosphor layers 410 are uniformly formed on both sidewalls of the main partitions 401, on both side walls of each of the first and second auxiliary partitions 402 and 403, and on the second dielectric layer 49. It is understood, but not shown, that the use of both the first and second auxiliary partitions 402, 403 are not required in all circumstances, and that the lengths need not be the same in all circumstances.

A method of fabricating the various functional layers formed on the rear substrate 42 will now be described.

First, the rear substrate 42, which is made of transparent glass, is provided. An ITO layer (not shown) is formed on the rear substrate 42 by a sputtering method, and then patterned to form a plurality of strip-shaped address electrodes 48. Subsequently, the second dielectric layer 49 is entirely printed to cover the address electrodes 48.

Next, a screen (not shown) having the same pattern as the partitions 400 is securely fixed on the top surface of the second dielectric layer 49, and a raw material of the partitions 400 is printed, dried and heated using the screen to complete the partition 400.

The partitions 400 are formed on the second dielectric layer 49 at a predetermined angle to the address electrode 48, rather than parallel therewith, to partition the discharge space.

In addition, the partitions 400 are fabricated such that the main partitions 401 and the first and second partitions 402 and 403 are simultaneously formed. It is understood that the partitions 400 may also be formed by a sandblast method or a dry film method, in addition to the printing method.

Subsequently, the R, G and B phosphor layers 410 are formed inside the formed partitions 400. The phosphor layers 410 are formed on both side walls of the main partitions 401, on both side walls of each of the first and second auxiliary partitions 402 and 403, and on the second dielectric layer 49.

The front substrate 41 and the rear substrate 42 are sealed to each other, and are then vacuum-exhausted. The gases are next injected, thereby completing the plasma display panel 40. Specifically, the front substrate 41 and the rear substrate 42 are heated at a predetermined temperature to then be sealed to each other. Then, in order to remove impurities remaining inside the panel 40 (moisture), vacuum exhaustion is performed at approximately 300° C. using a predetermined exhausting device (not shown). In this case, since the predetermined space 420 is provided between two neighboring main partitions 401, exhaustion is easily achieved. After the exhaustion is completed, gases mainly consisting of xenon are injected. Then, the panel 40 is separated from the exhausting device to then be subjected to an aging discharge by applying a predetermined voltage, a getter (not shown) is cut, thereby completing the plasma display panel 40.

Figure 5:
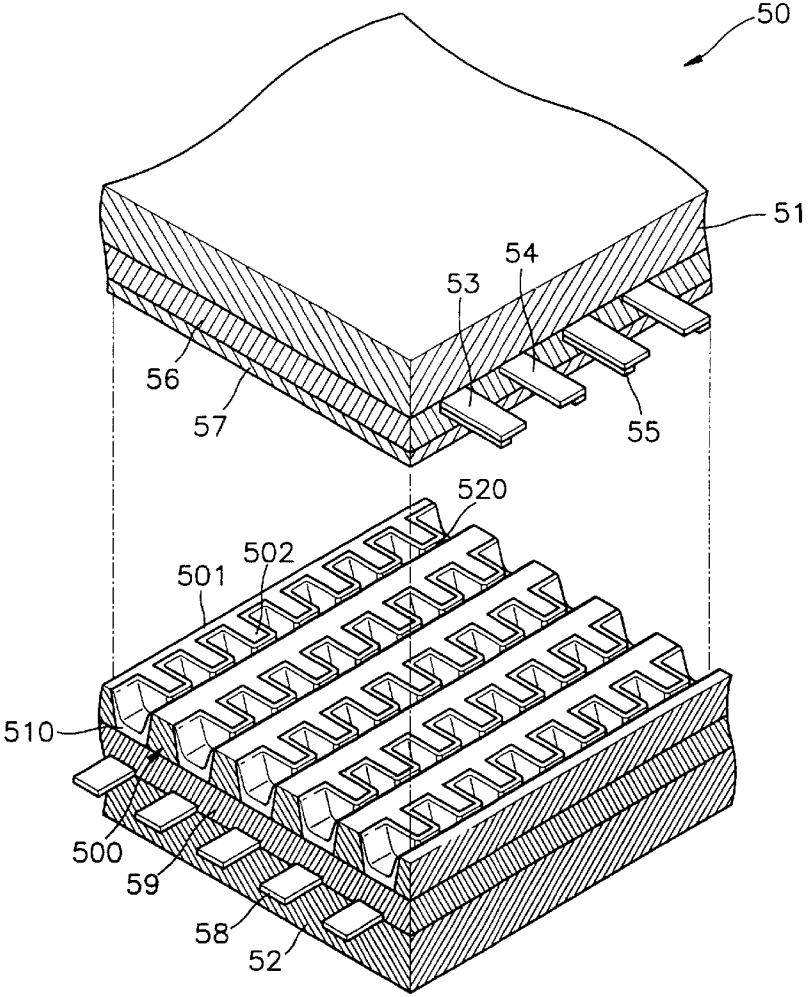
FIG. 5 is a partially exploded perspective view schematically illustrating a plasma display panel according to another embodiment of the present invention.

FIG. 5 illustrates a plasma display panel 50 according to another embodiment of the present invention. The panel 50 includes a front substrate 51 and a rear substrate 52. As similarly described above with reference to the plasma display panel 40 in FIG. 4, common and scan electrodes 53 and 54, bus electrodes 55, a first dielectric layer 56, and a protective layer 57 are formed on a bottom of the front substrate 51. Address electrodes 58, a second dielectric layer 59, partitions 500 and phosphor layers 510 are formed on the rear substrate 52 opposite to and facing the front substrate 51. As shown, the partitions 500 include main partitions 501, formed to be parallel with the address electrodes 58, and auxiliary partitions 502 extending from each of the main partitions 501. Specifically, strip-shaped main partitions 501 are formed in the space between each of the address electrodes 58. The auxiliary partitions 502 protrude a predetermined length from side walls of the main partitions 501 so as to be substantially perpendicular with the main partitions 501.

Each of the auxiliary partitions 502 is preferably long enough to allow for a predetermined space 520 between opposing sidewalls of two neighboring main partitions 501, as in the plasma display panel 40 in FIG. 4. In addition, the auxiliary partitions 502 are integrally formed with the main partitions 501 and are formed lengthwise with respect to the main partitions 501 to thus partition the discharge space. Also, the auxiliary partitions 502 are formed on the same sidewall of each main partition 501. The thicknesses of the auxiliary partitions 502 may be adjustable so as to cover the non-luminous region corresponding to a region where light is not radiated when power is supplied.

Figure 6:
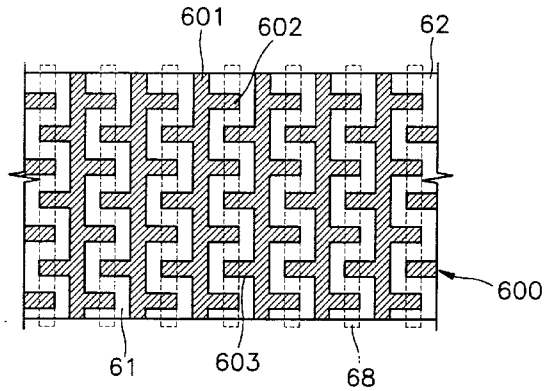
FIG. 6 is a partially exploded plan view schematically illustrating a rear substrate of a plasma display panel according to a still further embodiment of the present invention.

FIG. 6 is a partially exploded plan view schematically shows a rear substrate 62 of a plasma display panel according to yet another embodiment of the present invention. Only the characteristic parts of the present invention will now be described. A plurality of address electrodes 68 are formed on the rear substrate 62. The address electrodes 68 may be covered by a dielectric layer (not shown). Partitions 600 are formed on the dielectric layer. R, G and B phosphor layers 61 are formed between each of the partitions 600.

The partitions 600 include main partitions 601, spaced a predetermined distance apart from each other and parallel with the address electrodes 68, and a plurality of first auxiliary partitions 602 and second auxiliary partitions 603 substantially perpendicular with the main partitions 601. The first and second auxiliary partitions 602 and 603 are formed on opposite side walls of the main partitions 601 perpendicular with the main partitions 601. The first and second auxiliary partitions 602 and 603 protrude from both side walls of the main partitions 601 lengthwise. Also, the first and second auxiliary partitions 602 and 603 are preferably long enough to allow for a predetermined space 61 between opposing side walls of two neighboring main partitions 601, which is advantageous for exhaustion. The first and second auxiliary partitions 602 and 603 preferably have the same length. Accordingly, the first and second auxiliary partitions 602 and 603 alternate with each other such that first auxiliary partitions 602 protrude from one side wall of each main partition 601 and the second auxiliary partitions 603 protrude from the opposing side wall of the next main partition 601 to form a zig-zag pattern.

The R, G and B phosphor layers 61 are uniformly formed on both side walls of the main partitions 601, on the outer side walls of the first and second auxiliary partitions 602 and 603, and on the dielectric layer (not shown).

Figure 7:
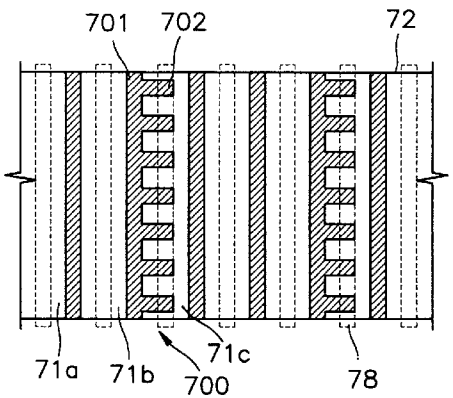
FIG. 7 is a partially exploded plan view schematically illustrating a rear substrate of a plasma display panel according to yet another embodiment of the present invention.

FIG. 7 is a partially exploded plan view schematically illustrating a rear substrate 72 of a plasma display panel according to a further embodiment of the present invention. Only the characteristic parts of the present invention will now be described. Address electrodes 78 are formed on the rear substrate 72. The address electrodes 78 may be covered by a dielectric layer (not shown). Partitions 700 are formed on the dielectric layer to be spaced a predetermined distance apart from each other. R, G and B phosphor layers 71*a*, 71*b* and 71*c* are formed between each of the partitions 700.

In the partitions 700, auxiliary partitions 702 are formed on the dielectric layer having the B phosphor layer 71*c* substantially perpendicular with main partitions 701. This compensates for the relatively low luminance of the B phosphor layer 71*c*, compared with R and G phosphor layers 71*a* and 71*b*. The auxiliary partitions 702 protrude from the main partitions 701 lengthwise, as described above. Accordingly, the B phosphor layer 71*c* has more area coated by phosphor than the R and G phosphor layers 71*a* and 71*b*. In other words, the B phosphor layer 71*c* is formed on the side walls of the main partitions 701, on the both side walls of the auxiliary partitions 702, and on the dielectric layer.

Figure 8:
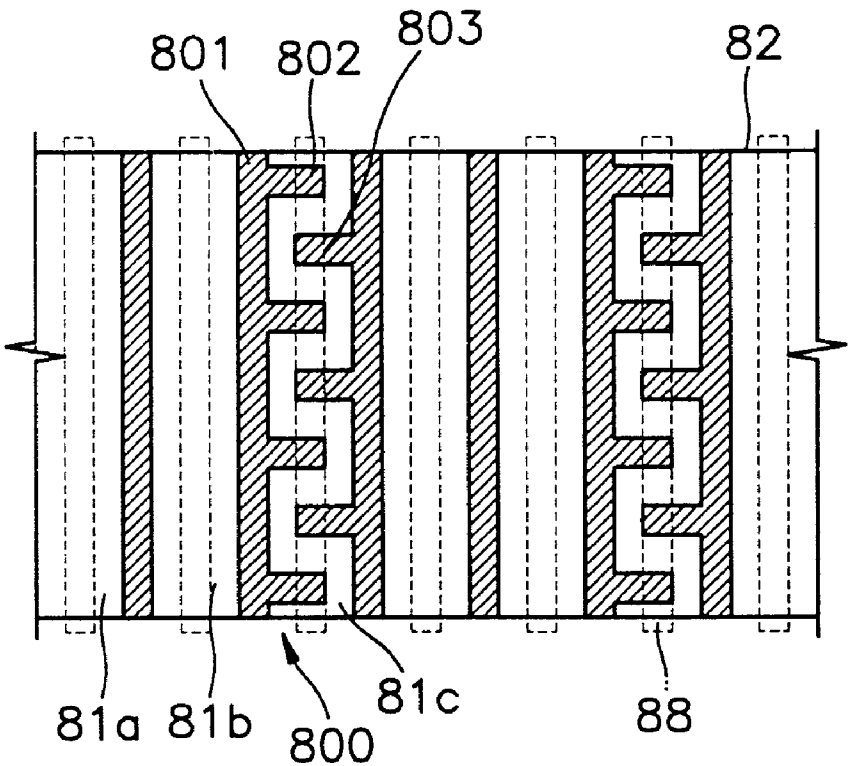
FIG. 8 is a partially exploded plan view schematically illustrating a rear substrate of a plasma display panel according to a further embodiment of the present invention.

FIG. 8 partially illustrates a plasma display panel according to a still further embodiment of the present invention, in which first and second auxiliary partitions 802 and 803 are formed on opposing side walls of two neighboring main partitions 801. Address electrodes 88 are formed on a rear substrate 82, which may be covered by a dielectric layer (not shown). Partitions 800 are formed on the dielectric layer, and R, G and B phosphor layers 81*a*, 81*b* and 81*c* are formed between each of the partitions 800. The first and second auxiliary partitions 802 and 803 alternate with each other such that the first auxiliary partitions 802 protrude from one side wall of a main partition 801 and the second auxiliary partitions 803 protrude from a next side wall of the next main partition 801 facing the one side wall. The B phosphor layer 81*c* has a wider phosphor coated area than the R and G phosphor layers 81*a* and 81*b*, thereby improving the luminosity of the B phosphor layer 81*c*.

As described above, in the AC type plasma display panel according to the present invention, partitions are formed on the rear substrate such that auxiliary partitions, which are spaced a predetermined distance apart from each other lengthwise, are integrally formed with each of main partitions. This results in increasing the phosphor coated area as to improve luminosity since phosphors are coated on the main partitions and side walls of auxiliary partitions. In addition, since a predetermined space is formed between ends of auxiliary partitions formed on a main partition and the side walls of the next main partition, smooth exhaustion is carried out during a vacuum exhausting step. Further, since main partitions and auxiliary partitions incorporated into the main partitions are simultaneously formed, the fabrication process thereof is easily performed. In addition, if auxiliary partitions are formed only on a region where a B phosphor layer having relatively low luminosity compared to R and G phosphor layers, the luminous efficiency of the B phosphor layer can be relatively improved. Further, the shade ratio can be improved by adjusting the thicknesses of auxiliary partitions formed on a portion corresponding to a non-luminous region when electricity is applied.

While not shown, it is understood that the gaps between partitions can also exist between the auxiliary partitions and the corresponding main partitions. Further, it is understood that the auxiliary partitions can be separately fabricated and added to an existing main partition.

While the invention has been described in detail and with reference to specific embodiments thereof, it is intended that the specification and examples be considered as exemplary only and it will be apparent to one skilled in the art that the present invention cover the modifications and variations of this invention provided they come within the scope of the appended claims and their equivalents. Therefore, a true scope and spirit of the invention are indicated by the appended claims.

What is claimed is:

1. An AC type plasma display panel comprising:

a front substrate;

strip-shaped common and scan electrodes on a bottom surface of said front substrate;

bus electrodes on one side of respective edges of said common and scan electrodes;

a first dielectric layer on the bottom surface of said front substrate to cover said common, scan, and bus electrodes;

a protective layer on a bottom surface of said first dielectric layer;

a rear substrate opposite to and facing said front substrate;

address electrodes on a top surface of said rear substrate, said address electrodes being perpendicular with said common and scan electrodes;

a second dielectric layer on said rear substrate to cover said address electrodes;

partitions to partition a discharge space under said protective layer, said partitions comprising main partitions formed on said second dielectric layer, and auxiliary partitions connected to the main partitions so as to not extend entirely between adjacent ones of the main partitions; and R, G and B phosphor layers formed on inner walls of said partitions.

2. The AC type plasma display panel according to claim 1, wherein the main partitions are at an angle to said address electrodes.

3. The AC type plasma display panel according to claim 2, wherein the auxiliary partitions comprise first auxiliary partitions extending from one side wall of each of the main partitions lengthwise, and second auxiliary partitions extending from an other side wall of the main partition lengthwise, the first and second auxiliary partitions being substantially perpendicular with the main partitions.

4. The AC type plasma display panel according to claim 3, wherein the first and second auxiliary partitions are alternately placed such that each first auxiliary partition extending from the one side wall of a respective one of the main partitions is adjacent to a respective one of the second auxiliary partitions extending from an opposing side wall of an adjacent one of the main partitions.

5. The AC type plasma display panel according to claim 1, wherein the main partitions are parallel with said address electrodes.

6. The AC type plasma display panel according to claim 5, wherein a plurality of the auxiliary partitions are on one side wall of a respective one of the main partitions lengthwise and are substantially perpendicular with the main partitions.

7. The AC type plasma display panel according to claim 6, wherein the auxiliary partitions on the one side wall of the respective main partitions are oriented in a same direction.

8. The AC type plasma display panel according to claim 5, wherein the auxiliary partitions include first auxiliary partitions extending from one side wall of each of the main partitions lengthwise, and second auxiliary partitions extending from an other side wall of each of the main partitions lengthwise.

9. The AC type plasma display panel according to claim 8, wherein the first and second auxiliary partitions of each main partition alternate with the first and second auxiliary partitions on an adjacent one of the main partitions.

10. The AC type plasma display panel according to claim 8, wherein the first auxiliary partitions are on one side wall of each of the main partitions and are oriented in a first same direction, and the second auxiliary partitions are on the other side wall of each of the main partitions and are oriented in a second same direction.

11. The AC type plasma display panel according to claim 1, wherein the auxiliary partitions are further on the main partitions lengthwise only at regions having the B phosphor layers.

12. The AC type plasma display panel according to claim 1, wherein the auxiliary partitions further comprise outer side walls having the R, G, B phosphor layers.

13. The AC type plasma display panel according to claim 1, wherein the auxiliary partitions are integral with side walls of the main partitions and have a length to provide a space between opposing side walls of two neighboring ones of the main partitions.

14. A plasma display panel comprising:

a front substrate having strip-shaped electrodes;

a rear substrate opposite to said front substrate, said rear substrate having address electrodes that are perpendicular with the strip-shaped electrodes;

a discharge area between the strip-shaped electrodes and the address electrodes;

partitions to partition said discharge area, said partitions comprising main partitions and auxiliary partitions where each auxiliary partition is between adjacent ones of the main partitions so as to allow exhaustion of gases between the adjacent ones of the main partitions; and phosphor layers in said partitions and on sides of said partitions.

15. The plasma display panel of claim 14, wherein the auxiliary partitions do not extend entirely between the adjacent ones of the main partitions.

16. The plasma display panel of claim 15, wherein the auxiliary partitions are attached to one of the adjacent main partitions.

17. The plasma display panel of claim 14, wherein the main partitions are parallel with each other, but are not parallel with said address electrodes.

18. The plasma display panel of claim 14, wherein the main partitions are parallel with each other and with said address electrodes.

19. The plasma display panel of claim 14, wherein the auxiliary partitions are alternately attached to the adjacent ones of the main partitions so as to form a zig-zag pattern through which gas is exhausted.

20. The plasma display panel of claim 14, wherein the auxiliary partitions have a varying thickness, wherein a thickness of the auxiliary partitions in a non-luminous area of the plasma display panel is greater than a thickness of the auxiliary partitions in a luminous area of the plasma display panel.

21. The plasma display panel of claim 14, wherein said phosphor layers in said partitions have different luminances, and the auxiliary partitions are selectively located in adjacent ones of the main partitions so as to increase or decrease the luminance of a respective one of the phosphor layers so as to create a uniform luminance for the plasma display panel.

22. The plasma display panel of claim 14, wherein the auxiliary partitions are perpendicular with said address electrodes.

23. The plasma display panel of claim 14, wherein a plurality of the auxiliary partitions extend from opposing sides of each main partition.

24. The plasma display panel of claim 14, wherein a plurality of the auxiliary partitions extend from a common side of each main partition, but do not extend from an opposing side of the main partition.

* * * * *